US006524021B2

(12) United States Patent
Johnson et al.

(10) Patent No.: US 6,524,021 B2
(45) Date of Patent: Feb. 25, 2003

(54) MULTIPLE ORIENTATION IMAGE FORMING DEVICE AND CARRIAGE FOR USE WITH SAME

(75) Inventors: Eric Joseph Johnson, San Diego, CA (US); Robert Warren Beauchamp, Carlsbad, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 16 days.

(21) Appl. No.: 09/730,019

(22) Filed: Dec. 4, 2000

(65) Prior Publication Data

US 2002/0067941 A1 Jun. 6, 2002

(51) Int. Cl.[7] ..... B41J 19/00
(52) U.S. Cl. ..... 400/354; 400/352
(58) Field of Search ..... 400/352, 354; 384/42; 347/37, 39

(56) References Cited

U.S. PATENT DOCUMENTS

| | | | | | |
|---|---|---|---|---|---|
| 1,837,363 | A | | 12/1931 | Helmond | 400/354.3 |
| 2,789,675 | A | | 4/1957 | Gebauer | 400/354.3 |
| 3,960,255 | A | * | 6/1976 | Bisson et al. | 400/120.16 |
| 3,987,882 | A | | 10/1976 | Kobryn | 400/120.16 |
| 4,227,219 | A | | 10/1980 | Takemoto | 347/37 |
| 4,514,100 | A | | 4/1985 | LaSpesa | 400/55 |
| 4,566,814 | A | | 1/1986 | Papp et al. | 400/354.1 |
| 4,576,496 | A | | 3/1986 | Schwarz et al. | 400/352 |
| 4,613,246 | A | | 9/1986 | Sugiura et al. | 400/320 |
| 4,714,354 | A | | 12/1987 | Satomi | 384/38 |
| 4,744,686 | A | | 5/1988 | Wakabayashi | 400/352 |
| 5,074,688 | A | | 12/1991 | Sato | 400/175 |
| 5,092,693 | A | | 3/1992 | Uchimura | 400/175 |
| 5,332,321 | A | | 7/1994 | Beauchamp et al. | 400/354 |
| 5,366,305 | A | | 11/1994 | Christianson | 400/354 |
| 5,596,241 | A | | 1/1997 | Seki et al. | 310/323 |
| 5,883,645 | A | * | 3/1999 | Ikado et al. | 347/30 |
| 2002/0001496 | A1 | * | 1/2002 | Ford | 400/76 |

FOREIGN PATENT DOCUMENTS

| | | | | |
|---|---|---|---|---|
| DE | 4317007 A | * | 11/1994 | |
| JP | 11-201155 A | * | 7/1999 | |
| JP | 2000234616 A | * | 8/2000 | F16C/17/02 |

OTHER PUBLICATIONS

Takei, Masabumi; Computer translation of Japanese Patent JP–2000234616–A from Japanese Patent Office website; Aug.–2000.*

* cited by examiner

*Primary Examiner*—Daniel J. Colilla

(57) ABSTRACT

A carriage including a printing component support and a pair of bushings having an inner region with at least three spaced rail contact regions separated by respective non-contact regions.

31 Claims, 5 Drawing Sheets

MULTIPLE ORIENTATION IMAGE FORMING DEVICE AND CARRIAGE FOR USE WITH SAME

BACKGROUND OF THE INVENTIONS

1. Field of the Invention

The present inventions are generally related to image forming devices and, more specifically, image forming devices including reciprocating carriage and guide rail systems.

2. Description of the Related Art

Many image forming devices, such as printers, plotters, copiers and facsimile machines, include a printing component that is mounted on a reciprocating carriage. The carriage slides (or "scans") back and forth on one or more cylindrical guide rails during an image formation procedure while the printing component forms an image, such as text or graphics, onto a substrate. Inkjet printers, for example, include one or more carriage mounted printhead cartridges (or "pens") that are carried on a printer carriage. The printhead cartridges typically include a printhead with a plurality of ink ejecting nozzles. During a printing operation, the printer carriage will traverse back and forth over the surface of the print medium as the print medium is advanced in a direction transverse to that of the carriage. A controller causes the nozzles to eject drops of ink at times intended to result in the desired image.

There are six degrees of possible movement for any object—three linear directions (X, Y, Z) and three rotational directions (θX, θY, θZ). It is vitally important that printer carriages scan back and forth in a straight line. In order to insure linear movement, the printer carriages must be constrained in two linear and three rotational directions. Constraining movement in, for example, the Y, Z, θX, θY, and θZ-directions is desirable because it leaves the printer carriage free to move only in the X-direction.

Many conventional printer carriages include a pair of longitudinally spaced circular bushings with a slightly greater diameter than that of the guide rail which extends through the bushings. The bushings are mounted on one side of the carriage, while a single guide pin is mounted on the other side. The guide pin prevents rotational movement about the guide rail axis. It has been found that such an arrangement is less than optimal. In order to insure that the carriage does not move in a direction other than the X-direction as the printer carriage scans back and forth, the bushings must be sized within extremely tight tolerances and essentially perfectly aligned with one another. Because such tolerances and alignments are not economically viable, the bushings have been made slightly larger than the guide rails. This leads to the possibility of movement of the printer carriage in directions other than the X-direction in response to external forces. Such movement, which is in the Y and Z-directions, leads to vibration of the printer carriage, unpredictability of the carriage location, binding and, ultimately, to a reduction in print quality.

One proposed solution to this problem is illustrated in commonly assigned U.S. Pat. No. 5,366,305. Here, the top portions of the printer carriage bushings (when the carriage is in the horizontal operating orientation and the printing component is facing vertically downward) include respective pairs of circumferentially spaced planar surfaces that, under the force of gravity, rest on the guide rail and provide two spaced lines of contact. Both surfaces are arranged at 45 degrees relative to a horizontal plane extending through the guide rail axis. The carriage is also provided with an anti-rotation roller that rides on a flat surface. Such an arrangement provides two spaced lines of contact with the guide rail and prevents the movement in the Y and Z-directions associated with circular bushings. Although the printer carriage disclosed in U.S. Pat. No. 5,366,305 is an improvement over those including circular bushings, the inventors herein have determined that such a system is inadequate in those instances where it is desirable to rotate the carriage about the θX axis to print in a direction other that vertically downward. For example, it may be desirable to rotate the printer carriage 90 degrees and mount the printer carriage such that the printing component is facing horizontally to print on the vertically extending side of a box. The planar portions of the bushings will not be on top when the carriage is rotated in this manner. The planar portions will be on one side of the guide rail. The guide rail will be in contact with the bushings at a point on one of the planar surfaces, which is arranged at 45 degrees, and with a vertically facing point on the bushing circular portion as gravity forces the bushings down against the guide rail. There will not be any constraint on the side of the bushings opposite the planar surfaces that are in contact with the guide rail. This leaves the printer carriage free to move in the Y-direction, thereby resulting in the aforementioned problems associated with movement in directions other than the X-direction.

The inventors have determined that one possible solution to the problems associated with mounting print carriages in a variety of orientations is to simply design and manufacture a special version of each print carriage for each particular orientation. This proposed solution is, however, untenable because of the manufacturing and inventory costs associated therewith.

SUMMARY OF THE INVENTIONS

Accordingly, one object of the present inventions is to provide apparatus that avoids, for practical purposes, the aforementioned problems in the art. In particular, one object of the present inventions is to provide a carriage for use in a printer or other image forming device that does suffer from the shortcomings associated with carriages that include circular bushings. Another object of the present inventions is to provide a carriage for use in a printer or other image forming device that can be operated in a plurality of angular orientations.

In order to accomplish some of these and other objectives, a carriage in accordance with one embodiment of a present invention includes a printing component support and a pair of bushings having an inner region with at least three spaced rail contact regions separated by respective non-contact regions. Such a carriage provides a number of important benefits. A bushing having at least three spaced rail contact regions will, for example, be in contact with appropriate portions of the rail at two spaced rail contact regions when the carriage is in any one of at least three different predetermined angular orientations. As a result, the carriage will be able to both avoid the shortcomings associated with circular bushings and operate without modification in at least three different angular orientations.

The above described and many other features and attendant advantages of the present inventions will become apparent as the inventions become better understood by reference to the following detailed description when considered in conjunction with the accompanying drawings.

BRIEF DESCRIPTION OF THE DRAWINGS

Detailed description of preferred embodiments of the inventions will be made with reference to the accompanying drawings.

DETAILED DESCRIPTION OF THE PREFERRED EMBODIMENTS

The following is a detailed description of the best presently known modes of carrying out the inventions. This description is not to be taken in a limiting sense, but is made merely for the purpose of illustrating the general principles of the inventions. Additionally, it is noted that detailed discussions of various internal operating components of printers which are not pertinent to the present inventions, such as specific details of inner workings of facsimile machines desktop printers, including their controllers and image processing systems, have been omitted for the sake of simplicity.

Figure 1:
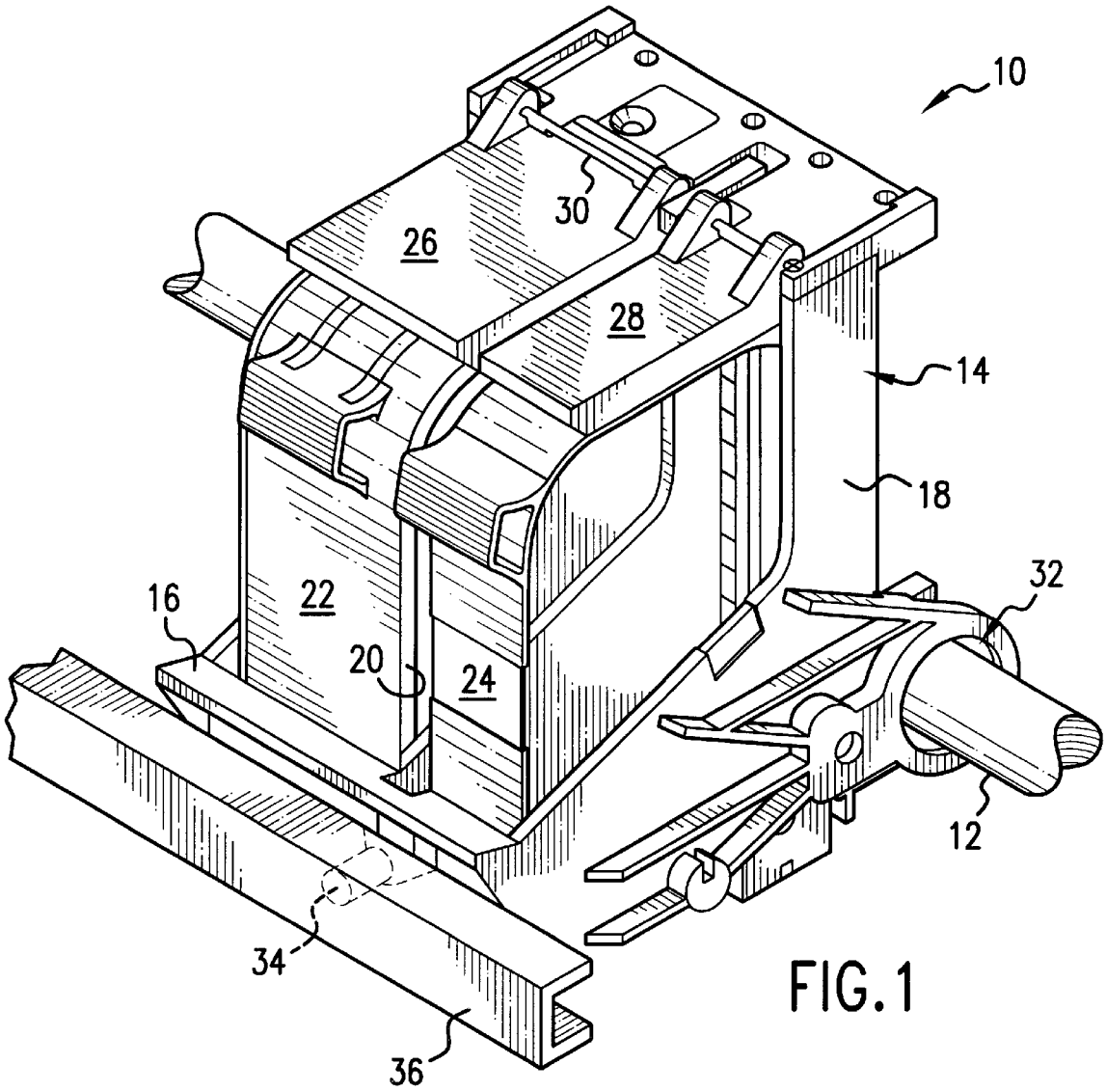
FIG. 1 is a perspective view of printer carriage in accordance with a preferred embodiment of a present invention.
Figure 2:
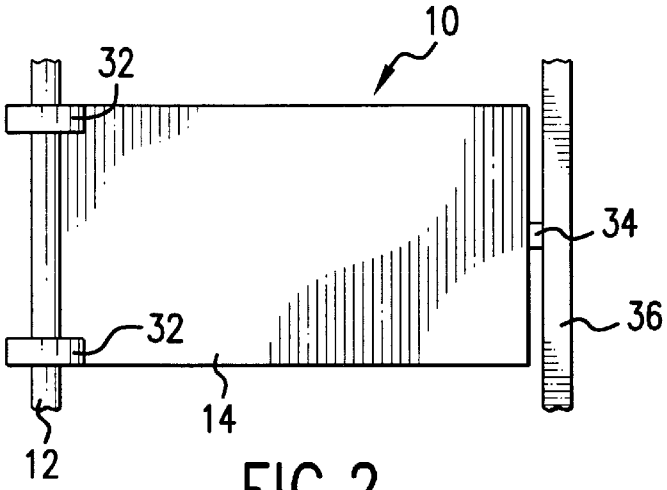
FIG. 2 is a bottom view of the printer carriage illustrated in FIG. 1.

As illustrated for example in FIGS. 1 and 2, a printer carriage 10 in accordance with one embodiment of a present invention reciprocatingly slides (or scans) back and forth along a guide rail 12 that defines the carriage scan axis. The exemplary printer carriage 10 consists primarily of a main body 14 having a front bar 16, L-shaped side walls 18, and an alignment web 20 that divides the interior of the main body into first and second chambers. The first and second chambers respectively house first and second removable ink jet printhead cartridges 22 and 24 (also referred to in the art as "pen cartridges,""print cartridges" and "cartridges"). A suitable printhead cartridge is the Hewlett-Packard TIJ 1.0 printhead cartridge (part no. 92261A). A pair of latch members 26 and 28, which are pivotably attached to a hinge 30, hold the printhead cartridges 22 and 24 in place.

The exemplary printer carriage 10 also includes a pair of identical bushings 32 (also referred to in the art as "bearings" and "glide bearings") which slidably support the carriage on the guide rail 12. An anti-rotation pin 34 mounted on the opposite side of the printer carriage 10 slides within a horizontally extending c-shaped anti-rotation guide 36. A roller may be used in place of the anti-rotation pin if desired. In either case, the slot formed by the anti-rotation guide 36 should be slightly larger than the pin 34 or roller (i.e. about 0.02 mm larger) to limit rotational movement about the carriage scan access to the extent practicable without preventing movement of the pin or roller in the scan direction. An endless belt and motor arrangement (not shown) may be used to drive the printer carriage 10 back and forth along the guide rail 12 in a conventional manner. The bushings 32 and anti-rotation pin 34 provide a printer carriage support system which prevents movement in five of the six possible directions.

Figure 3:
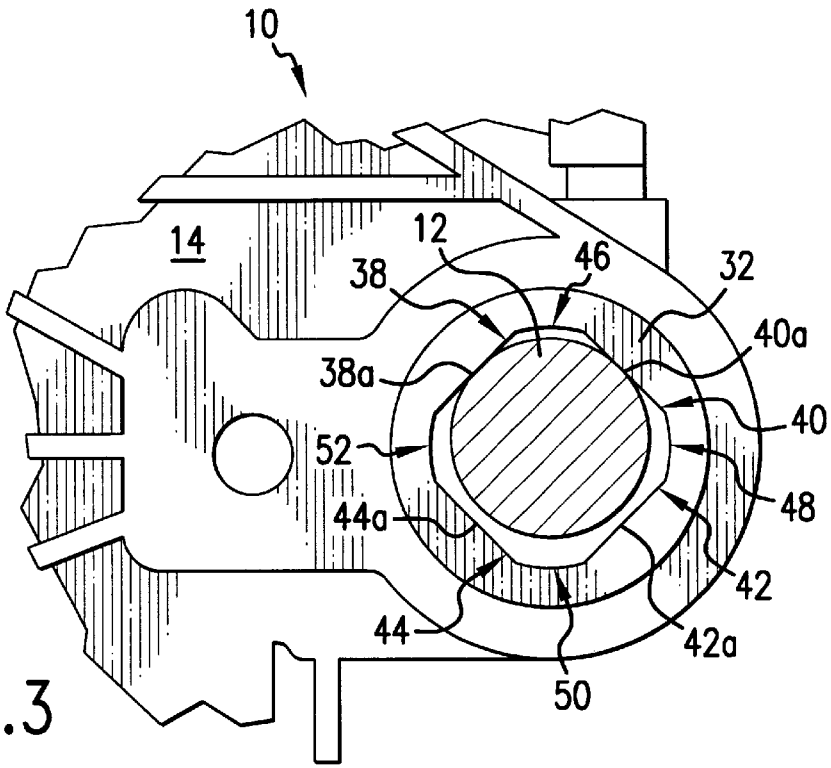
FIG. 3 is a side, partial section view of a bushing in accordance with a preferred embodiment of a present invention.
Figure 4C:
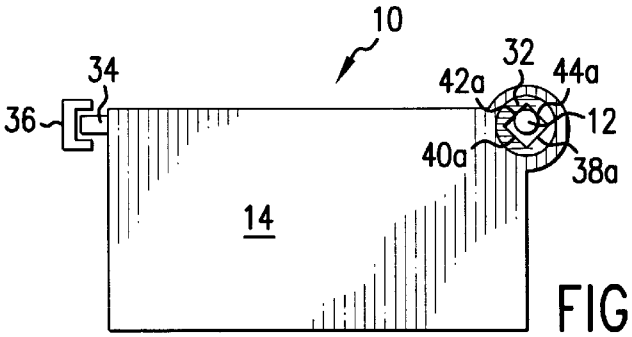
FIGS. 4A–4B are side diagrammatic views of the printer carriage illustrated in FIGS. 1–3 in four different angular orientations.
Figure 4D:
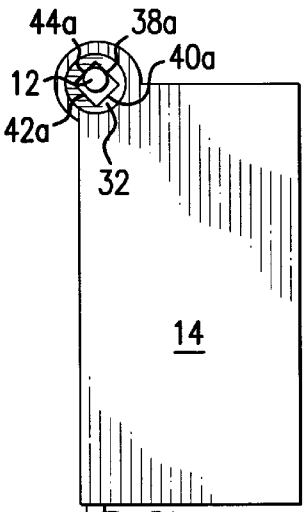
Figure 4B:
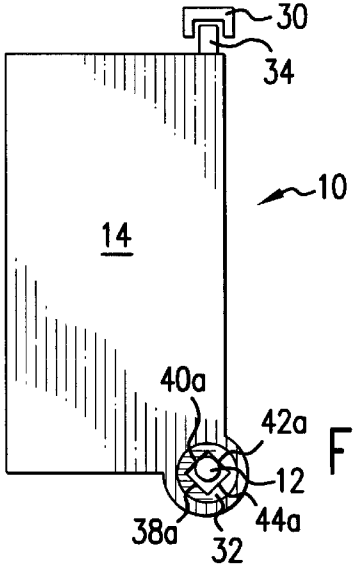
Figure 4A:
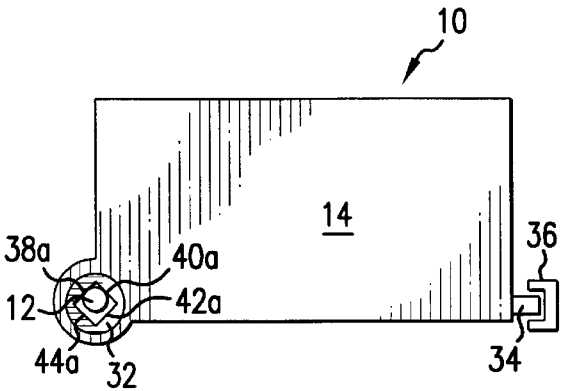

As illustrated for example in FIG. 3, the exemplary bushings 32 include four substantially planar contact surfaces (also referred to in the art as "facets") 38, 40, 42 and 44 that are tangential to the guide rail 12 and arranged at 45 degree angles to the horizontal plane in which the guide rail lies. The contact surfaces 38, 40, 42 and 44, which are preferably equally sized and spaced, define respective contact regions 38*a*, 40*a*, 42*a* and 44*a* located at 10:30, 1:30, 4:30 and 7:30 o'clock. The exemplary bushings 32 also include curved intermediate surfaces 46, 48, 50 and 52. The intermediate surfaces 46, 48, 50 and 52 and the portions of the contact surfaces 38, 40, 42 and 44 which do not the define contact regions 38*a*, 40*a*, 42*a* and 44*a* together form what are essentially non-contact regions.

The open interior regions of the bushings 32 are slightly larger than the guide rail 12 so that, as shown by way of example in FIG. 3, two of the contact regions 38*a*, 40*a*, 42*a* and 44*a* will be in contact with the guide rail 12 when the carriage is urged downwardly by gravitational forces. There will also be a small space between the guide rail 12 and the other two of the contact regions 38*a*, 40*a*, 42*a* and 44*a*. For example, the diameter of the cylindrical guide rail 12 in one implementation will be about 10 mm, while the contact regions 38*a* and 42*a* will be approximately 10.1 mm apart (as are regions 40*a* and 44*a*). Tolerances of about ±0.05 mm are acceptable in most applications. The length of the planar contact surfaces 38, 40, 42 and 44 in such an implementation would be about 3 mm.

Arranging the contact surfaces 38, 40, 42 and 44 such that they are all tangential to the guide rail 12 and at 45 degree angles from horizontal optimally balances of the level of friction between the contact regions 38*a*, 40*a*, 42*a* and 44*a* and the guide rail against the level of movement of the carriage in the Y-direction. However, other angular arrangements may be employed if desired for a particular application depending on the location and direction of the forces acting on the carriage during operation. The configuration of the printer carriage 10 and printhead cartridges 22 and 24 may, for example, require that the angular arrangement of one or more of the contact surfaces be other than tangential to the guide rail, that one or more of the contact surfaces be angled other than at 45 degrees from horizontal, and/or that one or more of the contact surfaces have a different length than the others.

One advantage of the present inventions is that the same carriage can be operated in a variety of predetermined angular orientations. The exemplary printer carriage 10 illustrated in FIGS. 1–3 is intended to be operated in four predetermined angular orientations, each offset 90 degrees from the next. Referring to FIGS. 4A–4D, two of the four contact regions 38*a*, 40*a*, 42*a* and 44*a* will be in contact with guide rail 12 in each of the four predetermined angular orientations—contact regions 38*a*/40*a* in FIG. 4A, contact regions 40*a*/42*a* in FIG. 4B, contact regions 42*a*/44*a* in FIG. 4C and contact regions 44*a*/38*a* in FIG. 4D. As a result, the present printer carriage 10 will realize the benefits associated with bushings having two spaced contact surfaces in each of the four angular orientations. It is expected that, in practice, there will be some tolerance with respect to the predetermined angular orientations. A suitable tolerance would be plus or minus 2 degrees.

The ability to operate the same printer carriage in a number of angular orientations is important because it allows a manufacturer to, for example, manufacture a single "print bar" assembly, consisting of a guide rail, an anti-rotation guide, a printer carriage, an endless belt and a motor, that can be used in a plurality of orientations. Conventional printer carriage and bushing technology, on the other hand, requires manufacturers to manufacture a unique version of a particular "print bar" assembly for each predetermined angular orientation.

Although the bushings 32 are intended to allow the exemplary carriage 10 to function in four predetermined angular orientations, the present inventions are not so limited. The bushings may be configured such that the carriage may be operated in any practicable number of predetermined angular orientations. This number may be less than four or greater than four. The bushing 54 illustrated in FIG. 5, for example, is designed to allow a carriage to function in six predetermined angular orientations. It includes contact six contact surfaces 56 and six contact regions 56*a*.

Figure 5:
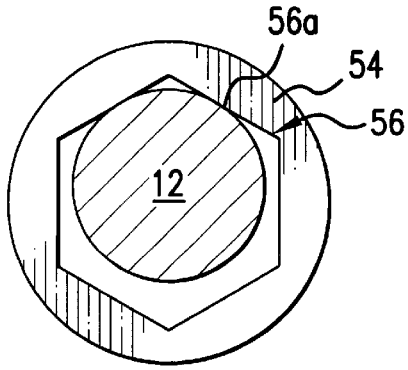
FIG. 5 is a side, partial section view of a bushing in accordance with another preferred embodiment of a present invention.
Figure 6A:
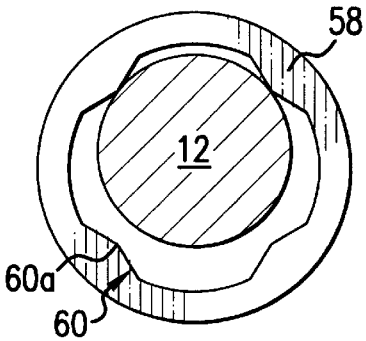
FIG. 6A is a side, partial section view of a bushing in accordance with yet another preferred embodiment of a present invention.
Figure 6B:
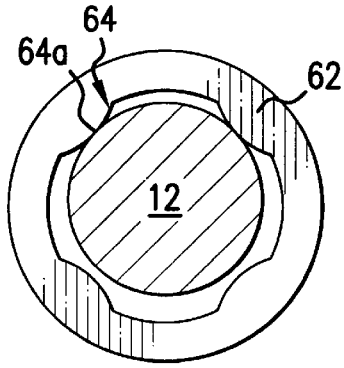
FIG. 6B is a side, partial section view of a bushing in accordance with still another preferred embodiment of a present invention.

The contact surfaces of the exemplary bushings illustrated in FIGS. 3–5 are substantially planar and the intermediate surfaces are curved. Nevertheless, the present inventions are not so limited. The contact surfaces may have a convex curvature, a concave curvature or have a somewhat pointed surface. The bushing 58 illustrated in FIG. 6A, for example, includes four contact surfaces 60 and each contact surfaces includes a pair of planar portions that form a somewhat pointed contact region 60*a*. The exemplary bushing 62 illustrated in FIG. 6B, on the other hand, includes four curved contact surfaces 64 with contact regions 64*a*. Moreover, a variety of contact surface styles may be incorporated into a single bushing. The shape of intermediate surfaces in any of the bushings are only important to the extent they provide structural integrity and can be inexpensively formed. Thus, they can be curved as illustrated in FIGS. 3, 6A and 6B, planar, or even eliminated as illustrated in FIG. 5. When eliminated, the non-contact regions will be made up solely of the portions of the contact surfaces which do not the define contact regions.

With respect to materials, suitable materials for the guide rail 12 and anti-rotation guide 36 include nickel plated carbon steel and stainless steel, while the bushings may be formed from materials such as bronze and plastics such as polycarbonate, polycarbonate with carbon (15%) and PTFE (6%) filling, and Nylon. Preferably, the bushing material will be oil-impregnated and produced by a sintering process that results in an oil content of about 19% by volume, which promotes lubrication of the guide rail 12. The bushings 32 are also preferably incorporated into the printer carriage 10 through an insert-molding process. Alternatively, the printer carriage 10 (or at least a portion thereof) and bushings 32 may be combined into an integral, unitary structure formed from one of the aforementioned plastic materials by, for example, a molding process.

The thickness of the bushings (measured in the direction of the guide rail axis), as well as the amount of material located between the contact surfaces and the exterior of the bushings, will depend on factors such as the weight of printer carriage 10, the bushing material and configuration, the loads on the carriage, and the intended application. For the otherwise conventional printer carriage 10 employing bronze as the material for the bushing illustrated in FIG. 3, the thickness of the bushings would be about 4 mm and the outer diameter would be about 13 to 14 mm.

Figure 7A:
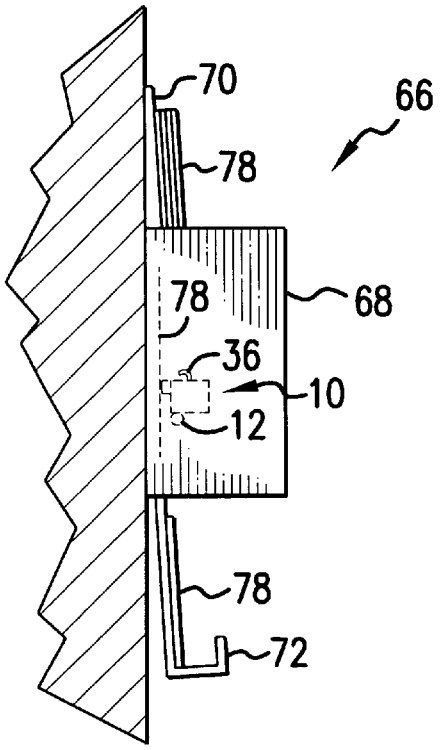
FIG. 7A is side view of a wall mounted facsimile machine in accordance with a preferred embodiment of a present invention.
Figure 7B:
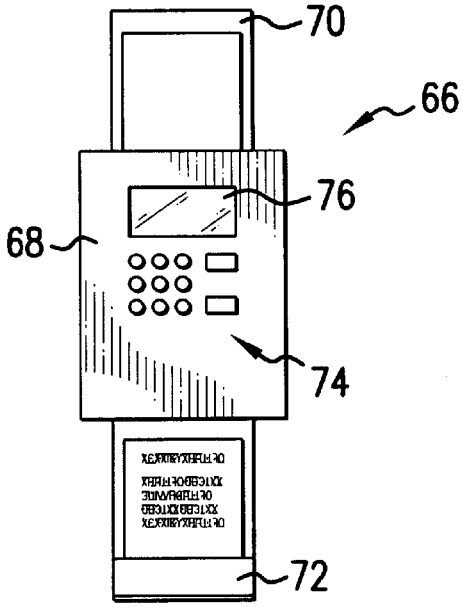
FIG. 7B is a front view of the facsimile machine illustrated in FIG. 7A.

A wall mounted facsimile machine 66, which is illustrated for example in FIGS. 7A and 7B, is one example of an image forming device in accordance with the present inventions. For the purpose of brevity, the otherwise conventional features of facsimile machines are not discussed here. The facsimile machine 66 includes a housing 68, a paper (or other substrate) supply tray 70, and an output tray 72. The forward facing side of the housing 68 may be provided with a plurality of buttons 74 and a display 76. Alternatively, a touch screen may be employed. The exemplary facsimile machine 66 also includes a printer carriage 10 oriented in the manner similar to that illustrated in FIG. 4B with the printhead cartridges facing horizontally and the contact regions 40*a* and 42*a* in contact with guide rail 12. Sheets of paper 78 from the supply tray feed vertically downward into the housing 68 where images are formed by the printhead cartridges as the printer carriage 10 scans back and forth. The sheets are then directed to the output tray 72.

Figure 8:
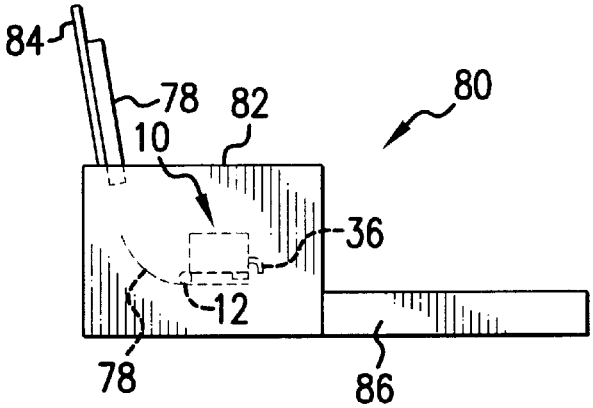
FIG. 8 is a side view of a desktop printer in accordance with a preferred embodiment of a present invention.

The same printer carriage 10 can be mounted in a conventional desktop printer, such as the printer 80 illustrated in FIG. 8. For the purpose of brevity, the otherwise conventional features of desktop printers are not discussed here. The printer includes a housing 82, a paper (or other substrate) supply tray 84, and an output tray 86. Here, however, the printer carriage is mounted in a manner similar to that illustrated in FIG. 4A with the printhead cartridges facing vertically downward. The sheets 78 are fed along a curved paper path from the supply tray 84, though the housing 82 and into the output tray 86.

Yet another example of an image forming device in accordance with the present inventions is a tag and label printer. The manufactures of such printers sometimes intend for the printers to be mounted with the printheads facing downwardly to, for example, form images on mail that is being transported by a conveyor belt, or with the printheads facing horizontally to, for example, form images on a vertically extending side of a box as it is being transported by a conveyor belt. The printer service station in such a printer would include a bushing and pin arrangement similar to that illustrated for in FIGS. 1–3.

Although the present inventions have been described in terms of the preferred embodiments above, numerous modifications and/or additions to the above-described preferred embodiments would be readily apparent to one skilled in the art. By way of example, but not limitation, It is intended that the scope of the present inventions extend to all such modifications and/or additions.

We claim:

1. A carriage for use in an image forming device including a rail and adapted to operate in a plurality of intended orientations, the carriage comprising:

a printing component support; and a pair of bushings, each bushing including an inner region with a plurality of rail contact region pairs, the number of rail contact region pairs being equal to the number of intended orientations, each rail contact region pair including two rail contact regions separated by a non-contact region.

2. A carriage as claimed in claim 1, wherein the printing component support is adapted to support at least one printhead cartridge.

3. A carriage as claimed in claim 1, wherein the number of intended orientations is equal to four and the number of rail contact region pairs is equal to four.

4. A carriage as claimed in claim 1, wherein the rail contact region pairs include planar surfaces.

5. A carriage as claimed in claim 1, wherein the plurality of rail contact region pairs are equally spaced.

6. A carriage as claimed in claim 1, further comprising:

an anti-rotation pin in spaced relation to the bushings.

7. An image forming device as claimed in claim 1, wherein adjacent pairs of rail contact region pairs include a common rail contact region.

8. A carriage as claimed in claim 1, wherein the printing component support and bushings together define a unitary structure.

9. An image forming device, comprising:

a printing component support;

a guide rail defining a curved exterior surface; and a pair of bushings through which the guide rail extends, each bushing including an inner region with at least three spaced rail contact regions separated by respective non-contact regions;

the guide rail and bushings being respectively configured such that one of the at least three spaced rail contract regions will be spaced from the guide rail when two of spaced rail contact regions are in contact with the guide rail.

10. An image forming device as claimed in claim 9, wherein the printing component support is adapted to support at least one printhead cartridge.

11. An image forming device as claimed in claim 9, wherein the at least three spaced rail contact regions comprise at least four spaced rail contact regions.

12. An image forming device as claimed in claim 9, wherein the at least three spaced rail contact regions comprise substantially planar surfaces.

13. An image forming device as claimed in claim 9, wherein the at least three spaced rail contact regions are equally spaced.

14. An image forming device as claimed in claim 9, wherein the printing component support and bushings together define a unitary structure.

15. An image forming device as claimed in claim 9, wherein the guide rail defines a circular cross-section.

16. An image forming device adapted to operate in a plurality of intended orientations, the image forming device comprising:

a printing component support;

a guide rail; and a pair of bushings through which the guide rail extends, each bushing including an inner region with a plurality of rail contact region pairs, the number of rail contact region pairs being equal to the number of intended orientations, each rail contact region pair including two rail contact regions separated by a non-contact region.

17. An image forming device as claimed in claim 16, wherein the printing component support is adapted to support at least one printhead cartridge.

18. An image forming device as claimed in claim 16, wherein the number of intended orientations is equal to four and the number of rail contact region pairs is equal to four.

19. An image forming device as claimed in claim 16, wherein the rail contact region pairs include planar surfaces.

20. An image forming device as claimed in claim 16, wherein the plurality of rail contact region pairs are equally spaced.

21. An image forming device as claimed in claim 16, further comprising:

a substantially c-shaped guide; and an anti-rotation pin, in spaced relation to the bushings, within the c-shaped guide.

22. An image forming device as claimed in claim 16, wherein adjacent pairs of rail contact region pairs include a common rail contact region.

23. An image forming device as claimed in claim 16, wherein the printing component support and bushings together define a unitary structure.

24. A carriage for use in an image forming device including a rail defining a size, the carriage comprising:

a printing component support; and a pair of bushings, each bushing including an inner region with at least three spaced non-planar rail contact regions separated by respective non-contact regions, the bushings being respectively sized such that one of the at least three spaced non-planar rail contact regions will be spaced from the guide rail when two of spaced non-planar rail contact regions are in contact with the guide rail.

25. A carriage as claimed in claim 24, wherein the at least three spaced non-planar contact regions comprise curved contact regions.

26. A carriage as claimed in claim 24, wherein the at least three spaced non-planar contact regions comprise substantially pointed contact regions.

27. A carriage as claimed in claim 24, wherein the printing component support is adapted to support at least one printhead cartridge.

28. A carriage as claimed in claim 24, wherein the at least three spaced non-planar rail contact regions comprise at least four spaced non-planar rail contact regions.

29. A carriage as claimed in claim 24, wherein the at least three spaced non-planar rail contact regions are equally spaced.

30. A carriage as claimed in claim 24, further comprising:

an anti-rotation pin in spaced relation to the bushings.

31. A carriage as claimed in claim 24, wherein the printing component support and bushings together define a unitary structure.

* * * * *